US008064816B2

(12) United States Patent
Campbell et al.

(10) Patent No.: US 8,064,816 B2
(45) Date of Patent: Nov. 22, 2011

(54) PRINTER INCLUDING A FUSER ASSEMBLY WITH BACKUP MEMBER TEMPERATURE SENSOR

(75) Inventors: Thomas Judson Campbell, Georgetown, KY (US); Jichang Cao, Lexington, KY (US); William Paul Cook, Lexington, KY (US); James Douglas Gilmore, Lexington, KY (US); Hrishikesh Pramod Gogate, Lexington, KY (US); James Allen Lokovich, Georgetown, KY (US); Wesley David McIntire, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 427 days.

(21) Appl. No.: 12/055,399

(22) Filed: Mar. 26, 2008

(65) Prior Publication Data

US 2009/0245835 A1 Oct. 1, 2009

(51) Int. Cl.
*G03G 15/00* (2006.01)
*G03G 15/20* (2006.01)

(52) U.S. Cl. ..... 399/389; 399/45; 399/69

(58) Field of Classification Search ..... 399/45, 399/68, 69, 320, 330, 334, 389; 219/216; 271/265.02, 265.03
See application file for complete search history.

(56) References Cited

U.S. PATENT DOCUMENTS 5,742,865 A * 4/1998 Yajima et al. ..... 399/43
5,848,319 A 12/1998 Morigami et al.
6,304,731 B1 * 10/2001 Able et al. ..... 399/45
6,801,729 B2 * 10/2004 Wada et al. ..... 399/68
7,010,255 B2 3/2006 Yura et al.
7,022,944 B2 4/2006 Yoshinaga et al.
7,397,488 B2 * 7/2008 Ito et al. ..... 347/171
7,460,797 B2 12/2008 Yoshikawa
2007/0071475 A1 * 3/2007 Blair et al. ..... 399/68
2007/0189786 A1 8/2007 Aoki et al.
2009/0066005 A1 * 3/2009 Maddux et al. ..... 271/3.13
2010/0172661 A1 * 7/2010 Choi ..... 399/33

FOREIGN PATENT DOCUMENTS

JP 03293677 A * 12/1991
JP 10198216 A 7/1998
JP 2006078797 A * 3/2006
JP 2007199582 A * 8/2007

OTHER PUBLICATIONS

U.S. Appl. No. 11/948,077, filed Nov. 30, 2007, Cao, et al.
U.S. Appl. No. 12/055,561, Campbell et al.
U.S. Appl. No. 12/055,754, Cook et al.
U.S. Appl. No. 12/055,614, Shuman et al.
Non-Final Office Action for divisional, U.S. Appl. No. 12/983,038, dated Feb. 22, 2011.

* cited by examiner

*Primary Examiner* — Robert Beatty

(57) ABSTRACT

A printer is provided, including a substrate transport apparatus for moving substrates along a substrate path; a media sensor actuated by mid-width and full substrates but not by narrow width substrates; and a fuser assembly including a belt, a heater to heat the belt, a backup member to engage the belt so as to define a fusing nip with the belt, and a temperature sensor for sensing a temperature of a portion of the backup member engaging only full width substrates. A controller is coupled to the media sensor and the temperature sensor for determining whether a substrate moving through the fuser assembly is a narrow width, mid-width or full width substrate.

20 Claims, 11 Drawing Sheets

Heater Control Tables

| | BUR°C | Heating Rate °C / sec | Adjust °C | Substrates |
|---|---|---|---|---|
| 610 → | <45 | 17 | +10 | 2 |
| 606 → | 46-60 | 17 | +5 | 2 |
| 602 → | 61-90 | 18 | +5 | 1 |
| 600 → | 91-100 | 18 | 0 | 1 |
| 604 → | 101-110 | 19 | -5 | 1 |
| 608 → | 111-130 | 19 | -10 | 1 |
| 612 → | >131 | 20 | -10 | 1 |

Figure 9

| BUR°C | Target°C | Time (s) |
|---|---|---|
| <=100 | -30 | 3.0 |
| >100 | -30 | 2.0 |
| >=120 | -30 | 1.0 |

Figure 10

| Paper Type | Normal PPM | Normal Gap | Extended Gap | Reduced PPM |
|---|---|---|---|---|
| Transparency | 14.3 | 2.2 in | 5.25 in | 11.6 |
| Paper (low speed) | 15.0 | 1.6 in | 4.75 in | 12.0 |
| Paper (high speed) | 30.0 | 2.0 in | 4.60 in | 25.0 |

Figure 11

| | BUR°C | Adjust °C | Substrates |
|---|---|---|---|
| *706* → | <70 | +10 | 2 |
| *702* → | 71-80 | +5 | 2 |
| *700* → | 81-90 | 0 | 1 |
| *704* → | 91-100 | -5 | 2 |
| *708* → | 101-120 | -10 | 2 |
| *710* → | >120 | -15 | 2 |

Figure 12

| Paper Width / Type | BUR °C | Gap | Reset °C | Heater Offset °C |
|---|---|---|---|---|
| Nearly Narrow (173-195mm) | | | | |
| *821* → | 0-180 | 2.0 ← *826* | 120 | 0 |
| *822* → | 181-190 | 9.0 ← *827* | 120 | -10 |
| *823* → | >190 | 14.0 ← *828* | 120 | -12 |
| Narrow (<=163mm) | | | | |
| *811* → | 0-175 | 2.0 ← *816* | 120 | 0 |
| *812* → | 176-190 | 11.2 ← *817* | 120 | -15 |
| *813* → | >190 | 16.0 ← *818* | 120 | -18 |
| Envelopes | | | | |
| *801* → | 0-130 | 2.0 ← *806* | 120 | 0 |
| *802* → | 131-170 | 5.0 ← *807* | 120 | -8 |
| *803* → | 171-180 | 10.0 ← *808* | 120 | -15 |
| *804* → | 181-195 | 15.0 ← *809* | 120 | -20 |
| *805* → | >195 | 23.0 ← *810* | 120 | -25 |

Figure 13

PRINTER INCLUDING A FUSER ASSEMBLY WITH BACKUP MEMBER TEMPERATURE SENSOR

This application is related to U.S. patent application Ser. No. 12/055,614, filed concurrently herewith, entitled FUSER HEATER TEMPERATURE CONTROL; U.S. patent application Ser. No. 12/055,754, filed concurrently herewith, entitled FUSER ASSEMBLY FAN CONTROL; and U.S. patent application Ser. No. 12/055,561, filed concurrently herewith, entitled FUSER ASSEMBLY HEATER TEMPERATURE CONTROL, all of which are hereby incorporated by reference herein.

FIELD OF THE INVENTION

The present invention is directed to a printer comprising a fuser assembly including a backup member temperature sensor.

BACKGROUND OF THE INVENTION

In an electrophotographic (EP) imaging process used in printers, copiers and the like, a photosensitive member, such as a photoconductive drum or belt, is uniformly charged over an outer surface. An electrostatic latent image is formed by selectively exposing the uniformly charged surface of the photosensitive member. Toner particles are applied to the electrostatic latent image, and thereafter the toner image is transferred to a substrate intended to receive the final image. The toner image is fixed to the substrate by the application of heat and pressure in a fuser assembly. The fuser assembly may include a heated roll and a backup roll forming a fuser nip through which the substrate passes. The fuser assembly may also include a fuser belt and an opposing backup member, such as a backup roll.

Modern fuser assemblies may have a low thermal mass, in order to provide fast first fuse times. One such fuser assembly includes a fuser belt heated by a ceramic heater and a backup member.

SUMMARY OF THE INVENTION

In accordance with a first aspect of the present invention, a printer is provided comprising: substrate transport apparatus for moving substrates along a substrate path through the printer; a media sensor positioned along the substrate path so as to be actuated by mid-width substrates and full width substrates but not by narrow width substrates; a fuser assembly comprising a heat transfer member including a belt and a heater to heat the belt, a backup member adapted to engage the belt so as to define a fusing nip with the belt, and a temperature sensor for sensing a temperature of a portion of the backup member engaging full width substrates and not engaging mid-width substrates and not engaging narrow width substrates; and a controller coupled to the media sensor and the temperature sensor. Based on signals generated by the media sensor and the temperature sensor, the controller may determine whether a substrate moving along the substrate path and through the fuser assembly comprises a narrow width substrate, a mid-width substrate or a full width substrate.

The heat transfer member may comprise a heater assembly comprising the heater and a housing for mounting the heater, and the belt, comprising a flexible belt, positioned about the heater assembly and including an inner surface engageable with the heater so as to receive energy in the form of heat generated by the heater.

The backup member may comprise a driven backup member positioned in opposition to the heater assembly. Preferably, the flexible belt extends between the heater assembly and the driven backup member such that the fusing nip is defined between the backup member and the flexible belt.

The printer may further comprise a reference edge for contact by an edge of a substrate moving along the substrate path.

The media sensor may be positioned a spaced distance away from the reference edge so as to be actuated by mid-width substrates and full width substrates but not by narrow width substrates.

The temperature sensor may be positioned a spaced distance away from the reference edge so as to sense the temperature of the backup member portion engaging full width substrates and not engaging mid-width substrates and not engaging narrow width substrates.

The full width substrates are capable of being moved along the paper path by the substrate transport apparatus at a full rated process speed without the backup member overheating.

Preferably, the controller samples the temperature sensor during each fusing cycle at a first point in time after a leading edge of a substrate passes through the fusing nip and a first section on the backup member contacted by a portion of the substrate spaced from the leading edge moves adjacent to where the temperature sensor is located. The controller also preferably samples the temperature sensor during each fusing cycle at a second point in time after a trailing edge of the substrate passes through the fusing nip and a second section on the backup member contacted by a portion of the substrate spaced from the trailing edge moves adjacent to where the temperature sensor is located.

The controller preferably takes the difference between samples of the temperature sensor at the first and second points in time and determines that a substrate is a full width substrate if the temperature taken at the second point in time is less than the temperature taken at the first point in time and determines that the substrate is either a mid-width substrate or a narrow width substrate if the temperature taken at the second point in time is greater than the temperature taken at the first point in time.

The controller preferably samples the media sensor during a print cycle and determines that a substrate is a mid-width substrate or a full width substrate if the media sensor is actuated as the substrate passes the media sensor and determines that the substrate is a narrow width substrate if the media sensor is not actuated as the substrate passes the media sensor.

The controller preferably determines that a substrate is a narrow width substrate if the media sensor is not actuated by the substrate; determines that a substrate is a mid-width substrate if the temperature sensed by the temperature sensor taken at the second point in time is greater than the temperature sensed by the temperature sensor taken at the first point in time and the media sensor is actuated by the substrate; and determines that a substrate is a full width substrate if the temperature sensed by the temperature sensor taken at the second point in time is less than the temperature sensed by the temperature sensor taken at the first point in time and the media sensor is actuated by the substrate.

In accordance with a second aspect of the present invention, a printer is provided comprising: substrate transport apparatus for moving substrates along a substrate path through the printer; a fuser assembly comprising a heat transfer member including a belt and a heater to heat the belt, a backup member adapted to engage the belt so as to define a fusing nip with the belt, and a temperature sensor for sensing a temperature of a portion of the backup member; and a controller coupled to the temperature sensor. Based on signals generated by the temperature sensor, the controller determines whether a substrate moving along the substrate path has been contacted by the backup member portion.

The printer may further comprise a reference edge for contact by an edge of a substrate moving along the substrate path.

The temperature sensor is preferably positioned a spaced distance away from the reference edge so as to sense the temperature of the backup member portion engaging full width substrates and not engaging less than full-width substrates.

The controller preferably samples the temperature sensor during each fusing cycle at a first point in time after a leading edge of a substrate passes through the fusing nip and a first section on the backup member contacted by a portion of the substrate spaced from the leading edge moves adjacent to where the temperature sensor is located and samples the temperature sensor during each fusing cycle at a second point in time after a trailing edge of the substrate passes through the fusing nip and a second section on the backup member contacted by a portion of the substrate spaced from the trailing edge moves adjacent to where the temperature sensor is located.

The controller preferably takes the difference between samples of the temperature sensor at the first and second points in time and determines that a substrate has been contacted by the backup member portion if the temperature taken at the second point in time is less than the temperature taken at the first point in time.

The backup member portion preferably engages full width substrates moving through the fuser assembly. The controller may determine that a substrate exiting the fuser assembly has a width less than full width based on signals generated by the temperature sensor. The controller may control the substrate transport apparatus so as to change a process speed from a first speed to a slower second speed in response to the controller determining that the substrate has a width less than full width.

BRIEF DESCRIPTION OF THE DRAWINGS

The following detailed description of the preferred embodiments of the present invention can best be understood when read in conjunction with the following drawings, where like structure is indicated with like reference numerals, and in which:

FIGS. 9-13 illustrate example tables containing data which may be used by the controller when implementing the steps set out in FIGS. 5-8.

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
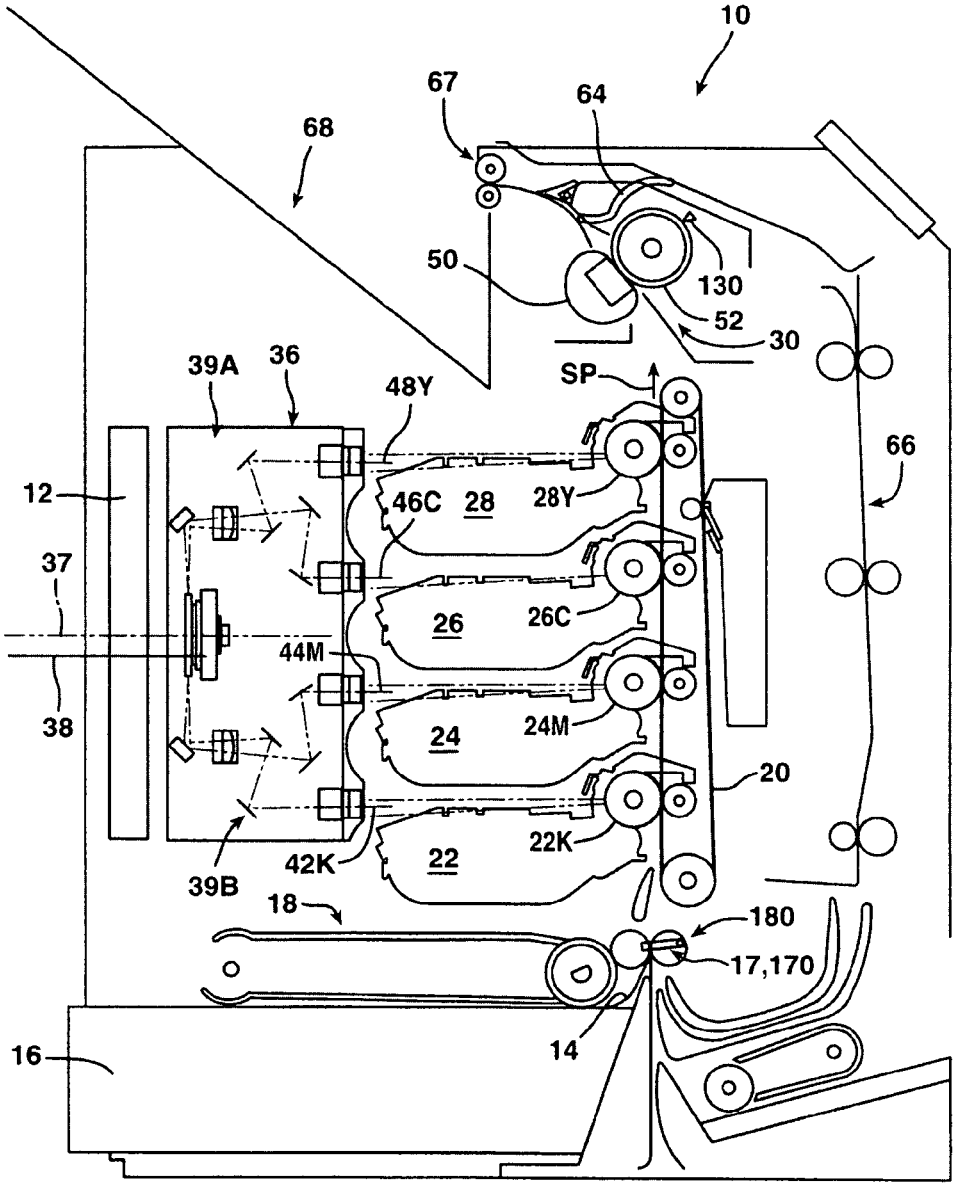
FIG. 1 is a schematic illustration of an electrophotographic printer including a fuser assembly in accordance with an embodiment of the present invention.

FIG. 1 depicts an electrophotographic image forming apparatus comprising a color laser printer, which is indicated generally by the reference numeral 10. An image to be printed is electronically transmitted to a print engine processor or controller 12 by an external device (not shown) or may comprise an image stored in a memory of the controller 12. The controller 12 includes system memory, one or more processors, and other logic necessary to control the functions of electrophotographic imaging.

In performing a print operation, the controller 12 initiates an imaging operation where a top substrate 14 of a stack of media is picked up from a media or storage tray 16 by a pick mechanism 18 and is delivered to a substrate transport apparatus comprising a pair of aligning rollers 180 and a substrate transport belt 20 in the illustrated embodiment. The substrate transport belt 20 carries the substrate 14 along a substrate path SP past each of four image forming stations 22, 24, 26, 28, which apply toner to the substrate 14. The image forming station 22 includes a photoconductive drum 22K that delivers black toner to the substrate 14 in a pattern corresponding to a black (K) image plane of the image being printed. The image forming station 24 includes a photoconductive drum 24M that delivers magenta toner to the substrate 14 in a pattern corresponding to the magenta (M) image plane of the image being printed. The image forming station 26 includes a photoconductive drum 26C that delivers cyan toner to the substrate 14 in a pattern corresponding to the cyan (C) image plane of the image being printed. The image forming station 28 includes a photoconductive drum 28Y that delivers yellow toner to the substrate 14 in a pattern corresponding to the yellow (Y) image plane of the image being printed. The controller 12 regulates the speed of the substrate transport belt 20, substrate pick timing, and the timing of the image forming stations 22, 24, 26, 28 to effect proper registration and alignment of the different image planes to the substrate 14.

To effect the imaging operation, the controller 12 manipulates and converts data defining each of the KMCY image planes into separate corresponding laser pulse video signals, and the video signals are then communicated to a printhead 36. The printhead 36 may include four laser light sources (not shown) and a single polygonal mirror 38 supported for rotation about a rotational axis 37, and post-scan optical systems 39A, 39B receiving the light beams emitted from the laser light sources. Each laser of the laser light sources emits a respective laser beam 42K, 44M, 46C, 48Y, each of which is reflected off the rotating polygonal mirror 38 and is directed towards a corresponding one of the photoconductive drums 22K, 24M, 26C, 28Y by select lenses and mirrors in the post-scan optical systems 39A, 39B.

The substrate transport belt 20 then carries the substrate 14 with the unfused toner image planes superposed thereon further along the substrate path SP to a fuser assembly 30. The fuser assembly 30 may comprise a heat transfer member 50 and a backup member comprising a backup roller 52 in the illustrated embodiment defining a pressure member cooperating with the heat transfer member 50 to define a fuser assembly nip 53 for conveying substrates 14 therebetween. The heat transfer member 50 and the backup roller 52 may be constructed from the same elements and in the same manner as the heat transfer member and pressure roller 52 disclosed in U.S. Pat. No. 7,235,761, the entire disclosure of which is incorporated herein by reference. The fuser assembly 30 further comprises a temperature sensor 130 for sensing the temperature of a portion 52A of the backup roller 52, a thermistor in the illustrated embodiment, see FIGS. 1-4.

The heat transfer member 50 may comprise a housing 58, a heater 59 supported on the housing 58, and an endless flexible fuser belt 60 positioned about the housing 58. A heater temperature sensor 57, such as a thermistor, is coupled to a surface of the heater 59 opposite a heater surface in contact with the belt 60. The belt 60 may comprise a flexible thin film, and preferably comprises a stainless steel tube having a thickness of approximately 35-50 microns, an elastomeric layer, such as a silicone rubber layer, having a thickness of approximately 250-350 microns, covering the stainless steel tube and a release layer, such as a PFA (polyperfluoroalkoxy-tetrafluoroethylene) sleeve, having a thickness of approximately 25-40 microns, covering the elastomeric layer. The release layer is formed on the outer surface of the stainless steel tube so as to contact substrates 14 passing between the heat transfer member 50 and the backup roller 52.

The backup roller 52 may comprise a hollow core 54 covered with an elastomeric layer 56, such as silicone rubber, and a fluororesin outer layer (not shown), such as may be formed, for example, by a spray coated PFA (polyperfluoroalkoxy-tetrafluoroethylene) layer, PFA-PTFE (polytetrafluoroethylene) blended layer, or a PFA sleeve. The backup roller 52 has an outer diameter of about 30 mm. The backup roller 52 may be driven by a fuser drive train (not shown) to convey substrates 14 through the fuser assembly 30.

An exit sensor 64, see FIG. 1, is provided downstream from the fuser assembly 30 for sensing and generating signals corresponding to the passage of successive substrates 14 through the fuser assembly 30.

After leaving the fuser assembly 30, a substrate 14 may be fed via exit rollers 67 into a duplexing path 66 for a duplex print operation on a second surface of the substrate 14, or the substrate 14 may be conveyed by the exit rollers 67 into an output tray 68.

Figure 4:
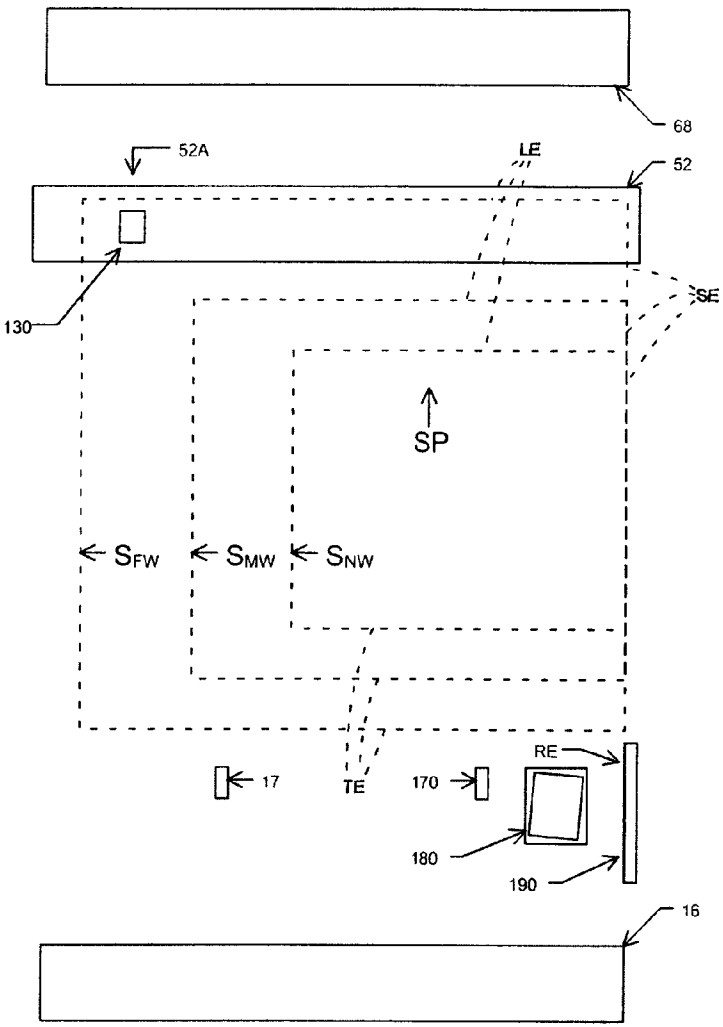
FIG. 4 is a schematic view of a substrate path SP including a printer reference edge RE.

The printer 10 further comprises a guide structure 190 defining a reference edge RE along an outer edge of a portion of the substrate path SP, see FIG. 4. A side edge SE of each substrate 14 engages and moves along the reference edge RE as it travels from the media tray 16 through the aligning rollers 180 to the substrate transport belt 20. Each substrate 14 stays aligned with the reference edge RE after it leaves the reference edge RE and travels further along the substrate path SP past the image forming stations 22, 24, 26 and 28, through the fuser assembly 30 and into the output tray 68, see FIG. 4, which is a schematic illustration of the substrate path SP including the reference edge RE.

In FIG. 4, three different substrates $S_{FW}$, $S_{MW}$ and $S_{NW}$ having three separate widths are shown in dotted line. Substrate $S_{FW}$ comprises a full width substrate and, in the illustrated embodiment, is an A4 substrate having a width of 210 mm. A full width substrate $S_{FW}$ may comprise any substrate having a width greater than about 205 mm. Substrate $S_{MW}$ comprises a mid-width substrate and, in the illustrated embodiment, is a B5 substrate having a width of 176 mm. A mid-width substrate may comprise any substrate having a width between about 173 mm and about 195 mm. Substrate $S_{NW}$ comprises a narrow width substrate and, in the illustrated embodiment, is an A5 substrate having a width of 148 mm. A narrow width substrate may have a width less than about 163 mm.

A first media sensor 17, comprising an optical interrupter and flag sensor, may be provided downstream from the pick mechanism 18 and prior to the first image forming station 22, see FIG. 1. In the illustrated embodiment, the media sensor 17 is spaced approximately 168 mm away from the reference edge RE, see FIG. 4, in a direction transverse to the direction of the substrate path SP. Hence, the first media sensor 17 is actuated by full width substrates $S_{FW}$ and mid-width substrates $S_{MW}$ as each such substrate $S_{FW}$, $S_{MW}$ moves along the substrate path SP and passes beneath the first media sensor 17. The first media sensor 17 is not actuated by narrow width substrates $S_N$ as those substrates do not pass beneath the media sensor 17 as they travel along the substrate path SP.

A second media sensor 170 may also be provided downstream from the pick mechanism 18 and prior to the first image forming station 22, see FIG. 4. In the illustrated embodiment, the second media sensor 170 is spaced approximately 40 mm away from the reference edge RE, see FIG. 4, in a direction transverse to the direction of the substrate path SP. Hence, the second media sensor 170 is actuated by full width substrates $S_{FW}$, mid-width substrates $S_{MW}$ and narrow width substrates $S_{NW}$ as each such substrate moves along the substrate path SP and passes beneath the second media sensor 170.

As noted above, the temperature sensor 130 senses the temperature of the backup roller portion 52A, see FIG. 4. In the illustrated embodiment, the temperature sensor 130 is spaced approximately 200 mm from the reference edge RE, see FIG. 4, in a direction transverse to the direction of the substrate path SP. The backup roller portion 52A comprises a circumferential portion of the backup roller 52, which is also spaced approximately 200 mm from the reference edge RE, see FIGS. 3 and 4. Hence, the backup roller portion 52A engages full width substrates $S_{FW}$ as each full width substrate $S_{FW}$ moves through the fuser assembly nip 53. However, the backup roller portion 52A does not engage mid-width substrates $S_{MW}$ or narrow width substrates $S_{NW}$ as those substrates do not extend in a widthwise direction from the reference edge RE to the backup roller portion 52A.

The controller 12 is coupled to the first and second media sensors 17 and 170 and the temperature sensor 130 for receiving corresponding signals generated by the media sensors 17 and 170 and the temperature sensor 130.

The printer 10 illustrated in FIG. 1 does not include a sensor associated with the tray 16 for sensing a width of the substrates 14 stored therein. An operator typically informs the printer 10 of a size (width) of the substrates 14 stored in the tray 16 as well as the size of substrates stored in one or more other trays (not shown) which may be associated with the printer 10. Substrate size information may be input to the printer 10 via an operator panel on the printer 10 or driver software running on a personal computer or the like coupled to the printer 10. However, an operator may place substrates 14 having a different size in the tray 16 or other trays associated with the printer 10 without updating the controller 12 as to the new substrate size.

Based on signals generated by the first media sensor 17 and the temperature sensor 130, the controller 12 is capable of determining whether a substrate 14 moving along the substrate path SP and through the fuser assembly comprises a narrow width substrate $S_{NW}$, a mid-width substrate $S_{MW}$ or a full width substrate $S_{FW}$. If narrow width substrates $S_{NW}$ are being printed and fused by the printer 10, yet the controller 12 has received information from the operator indicating that mid-width or full width substrates are being processed by the printer 10, the temperature of the backup roller 52, at portions of the backup roller 52 not contacting and not transferring energy in the form of heat to substrate material, may overheat causing degradation of the backup roller 52. Hence, if the controller 12 determines that a substrate or substrates 14 currently being printed are of a size different from that input to the printer 10 by the operator, the controller 12 will used the detected, updated substrate size information when controlling the operation of the heater 59.

Figure 2:
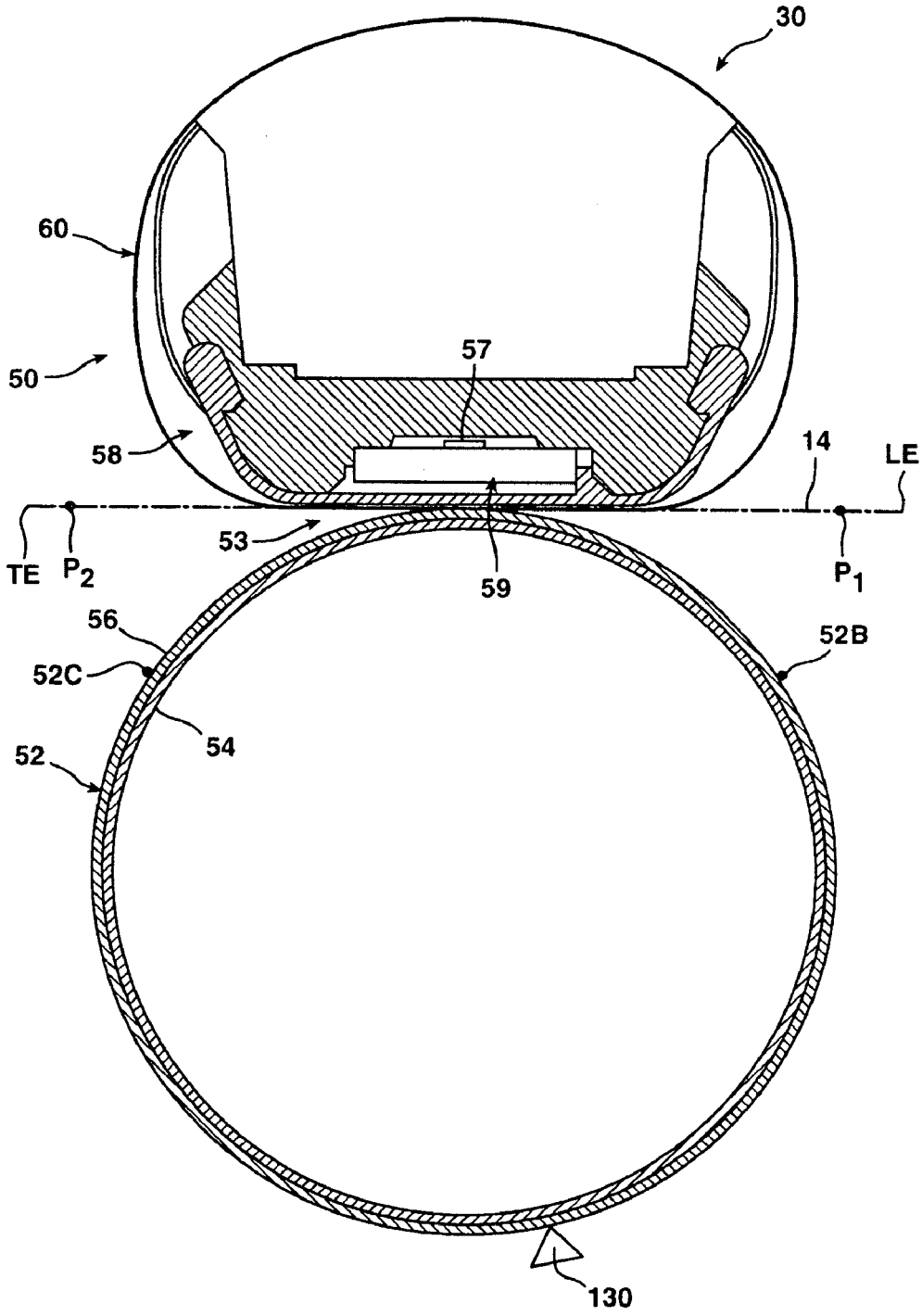
FIG. 2 is a side view, partially in cross section, of the fuser assembly illustrated in FIG. 1.
Figure 3:
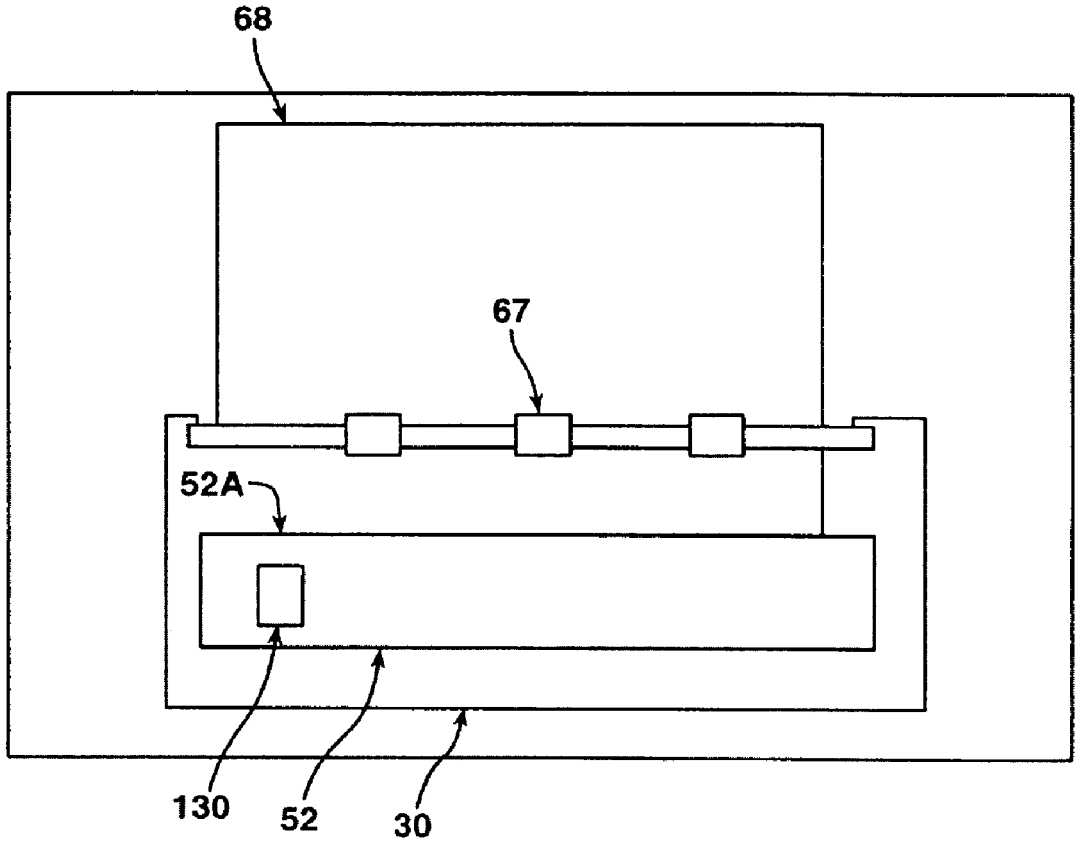
FIG. 3 is a schematic top view of the printer of FIG. 1.

Preferably, the controller 12 samples the temperature sensor 130 during each fusing cycle after a leading edge LE of a substrate $S_{FW}$, $S_{MW}$, $S_{NW}$ passes through the fuser assembly nip 53 at a first point in time when a first section 52B on the backup roller 52 previously contacted by a first portion $P_1$ of the substrate spaced about one inch after the substrate leading edge LE moves adjacent to where the temperature sensor 130 is located, see FIG. 2. The controller 12 also preferably samples the temperature sensor 130 during each fusing cycle after a trailing edge TE of the substrate passes through the fuser assembly nip 53 at a second point in time when a second section 52C on the backup roller 52 previously contacted by a second portion $P_2$ of the substrate spaced about one inch before the substrate trailing edge TE moves adjacent to where the temperature sensor 130 is located. The controller 12 knows the location of the leading and trailing edges LE, TE and the first and second portions $P_1$ and $P_2$ of each substrate 14 as the substrate 14 moves along the substrate path SP based on substrate size information, the process speed or linear speed of the belt 20, which the controller 12 controls, and signals generated by the second media sensor 170 indicating that a leading edge LE of the substrate 14 has moved beneath the media sensor 170.

The controller 12 preferably takes the difference between samples of the temperature sensor 130 at the first and second points in time and determines that a substrate 14 is a full width substrate $S_{FW}$ if the temperature taken at the second point in time is less than the temperature taken at the first point in time. A temperature decrease at the second point in time indicates that a substrate 14 has moved beneath the backup member portion 52A since energy in the form of heat was transferred from the backup member portion 52A to the substrate 14. The controller 12 further determines that the substrate 14 is either a mid-width substrate $S_{MW}$ or a narrow width substrate $S_{NW}$ if the temperature taken at the second point in time is greater than the temperature taken at the first point in time. A temperature increase at the second point in time indicates that a substrate 14 did not move beneath the backup member portion 52A as energy in the form of heat was not transferred to the substrate 14. Instead, the temperature of the backup member portion 52A increased.

The controller 12 also preferably samples the first media sensor 17 during a print cycle and determines that a substrate 14 is a mid-width substrate $S_{MW}$ or a full width substrate $S_{FW}$ if the first media sensor 17 is actuated as the substrate 14 passes the media sensor 17 and determines that the substrate 14 is a narrow width substrate $S_{NW}$ if the first media sensor 17 is not actuated as the substrate 14 passes the media sensor 17.

Hence, in the illustrated embodiment, the controller 12 determines that a substrate 14 is a narrow width substrate $S_{NW}$ if the first media sensor 17 is not actuated by the substrate 14 as it passes the media sensor 17; determines that a substrate 14 is a mid-width substrate $S_{MW}$ if the temperature sensed by the temperature sensor 130 taken at the second point in time is greater than the temperature sensed by the temperature sensor 130 taken at the first point in time and the first media sensor 17 is actuated by the substrate 14 as it passes the media sensor 17; and determines that a substrate 14 is a full width substrate $S_{FW}$ if the temperature sensed by the temperature sensor 130 taken at the second point in time is less than the temperature sensed by the temperature sensor 130 taken at the first point in time and the first media sensor 17 is actuated by the substrate 14 as it passes the media sensor 17.

In the illustrated embodiment, a print operation comprises the printing of a single substrate 14 or the printing of a plurality of successive substrates 14 of the same type, weight, texture and size at the same process speed prior to the printer 10 going into an idle state. During a print operation, the controller 12 generally maintains the heater 59 at a heater target temperature corresponding to the type, weight, texture and size of the substrate currently being printed as well as the current process speed. Hence, the controller 12 stores a plurality of heater target temperatures, each corresponding to a specific substrate type, weight, texture and size and process speed of the substrate path SP.

As noted above, information regarding type, weight, texture and size of the substrate(s) 14 in the tray 16 is typically input into the printer 10 by the operator via the operator panel or driver software. However, as also noted above, the size/width information input by the operator may be incorrect. Hence, if the heater 59 is controlled based on incorrect substrate size/width information, there is risk that the backup roller 52 may be damaged by excessive heat. For example, if operator input information indicates that full width substrates $S_{FW}$ are stored in the tray 16, but, instead, narrow width substrates $S_{NW}$ are provided, there is risk that the backup roller 52 may overheat at portions of the backup roller 52 not contacting and transferring energy in the form of heat to substrate material. As further noted above, the controller 12 is capable of determining the size of a substrate 14 by sampling signals generated by the first media sensor 17 and the backup roller temperature sensor 130. If the controller 12 determines that the operator input substrate size information is incorrect, the controller will use the sensed, updated substrate size information when controlling the operation of the heater 59.

It is noted that the controller 12 continuously samples the backup roller temperature sensor 130. If the sensed temperature of the backup roller 52 exceeds an upper threshold temperature, e.g., 210 degrees C, the controller 12 will turn the heater 59 off and cause a display panel (not shown) on the printer 10 to display an error notation.

As will now be described, the controller 12 may vary or change a heater target temperature, a substrate pick time, a substrate pick rate and/or a substrate path process speed based on substrate size and the backup roller temperature as sensed by the temperature sensor 130.

For each print operation received by the printer controller 12, the controller 12 first determines, based on operator input, the type, weight, texture and size of the substrate(s) 14 provided in the substrate tray 16 or any other tray associated with the printer 10 storing a substrate or substrates to be printed in an upcoming print operation. Based on this operator input information and the substrate path process speed, the controller 12 determines and sets a corresponding heater target temperature for that print operation, see step 202 in FIG. 5. For a second or subsequent substrate of a given print operation, the controller 12 may use sensed, updated substrate size information, determined as noted above, when controlling the operation of the heater 59 such that a new heater target temperature and/or process speed may be selected. For example, when the controller 12 determines that a substrate exiting the fuser assembly 30 has a width less than full width, the controller 30 may control the substrate transport apparatus so as to change a process speed from a first speed (full speed) to a slower second speed (slow speed) in response to determining that the substrate has a width less than full width. In the case where a new process speed is selected, the controller 12 will typically let the substrate path SP clear of all substrates prior to picking a first substrate to be printed and processed using the updated process speed. The controller 12 then returns to step 202.

Figure 5:
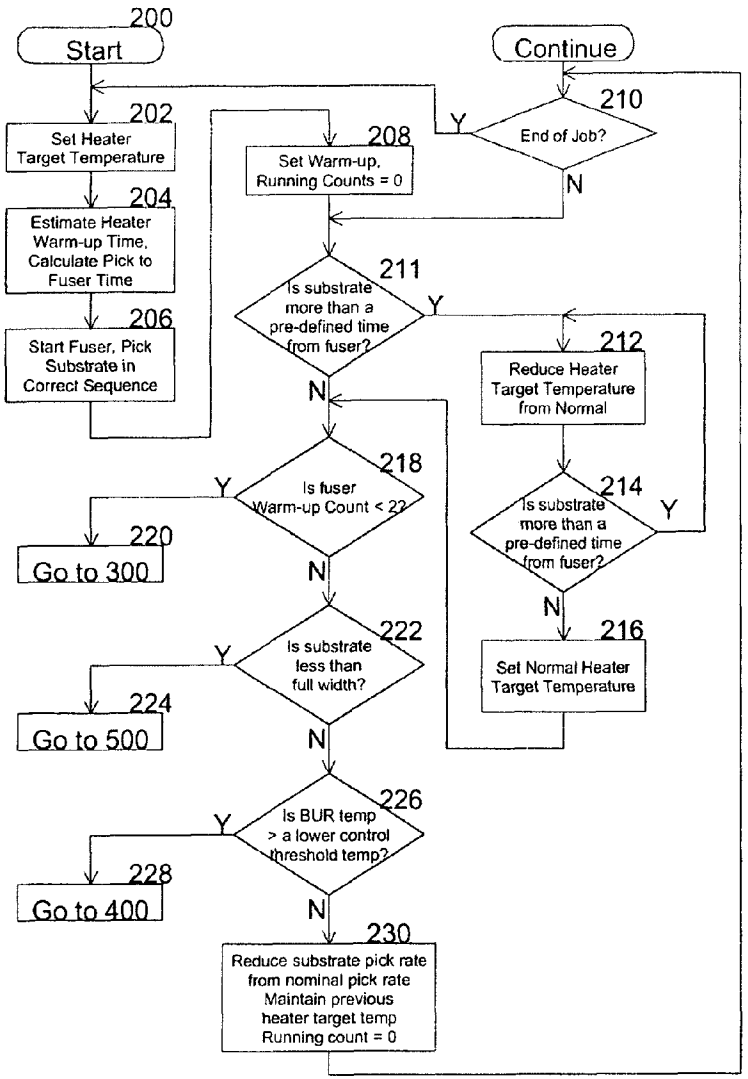
FIGS. 5-8 are flow charts illustrating steps implemented by a controller of the printer in FIG. 1 to control the operation of a heater of the printer of FIG. 1.

For a first substrate of the print operation to be printed, the controller 12 estimates a warm-up time for the heater 59 using, in the illustrated embodiment, data in a table set out in FIG. 9 and stored in a lookup table by the controller 12, see step 204 in FIG. 5. The controller 12 takes a difference between a current heater temperature, as sensed by the heater temperature sensor 57, and a desired heater temperature, such as a current or set heater target temperature, and divides the difference by a heating rate for the heater 59. The heater heating rate may be estimated using the table in FIG. 9 and the current backup roller temperature. For example, if the current backup roller temperature is equal to 70 degrees C., the heater heating rate will be 18 degrees C./second as determined from the table of FIG. 9 using the current backup roller temperature as an input into the table. The controller 12 further estimates a time for the first substrate 14 of the print operation to be picked, moved along the substrate path SP and enter the fuser assembly nip 53, see step 204 in FIG. 5. The substrate travel time is estimated based on the current process speed, which the controller 12 controls and has knowledge of, and the distance the tray storing the substrate 14 is spaced from the nip 53. By estimating the travel time for the substrate 14 and the warm-up time for the heater 59, the controller 12 can determine when to start providing current to the heater 59 such that the heater 59 is at the desired heater temperature when the first substrate 14 of the print operation is expected to enter the nip 53.

The controller 12 picks the first substrate 14 of the print operation and provides current to the heater 59 at the determined time such that the heater 59 reaches the desired heater temperature when the substrate 14 is expected to enter the nip 53, see step 206 in FIG. 5. The controller 12 further sets warm-up and running counts equal to 0 for the print operation, see step 208 in FIG. 5.

After step 208, the controller 12 implements the remaining steps set out in FIG. 5 for each substrate 14 to be printed as part of the current print operation including the first substrate of the print operation.

In step 211 of FIG. 5, the controller 12 determines if a substrate 14, next to be printed, is delayed such that it will reach the fuser assembly 30 late. The controller 12 knows the location of each substrate 14 moving along the substrate path 12 based on the current process speed, the location of the tray that stored the substrate 14 and the time when the substrate actuated the second media sensor 170. If a substrate 14 does not enter the fuser assembly nip 53 at an expected time, the fuser assembly 30 can overheat. Substrate delay can occur for a first substrate of a print operation when the substrate tray 16 is empty as the controller 12 may start providing current to the heater 59, see step 206, prior to making a first attempt to pick a substrate and, once a substrate pick attempt is made, it is unsuccessful due to no substrates being in the tray 16. Substrate delay can occur for a second or subsequent substrate of a print operation when image data conversion has not yet been completed such that the substrate 14 is picked from the tray late; the substrate tray 16 is empty; or there is a large gap between the substrate 14 to be picked and printed and a previously printed substrate. In the illustrated embodiment, to conclude that a substrate 14 is delayed, the controller 12 determines if the substrate 14 is more than a predefined time period away from the fuser assembly nip 53 at a point in time when fusing of a just previously picked substrate has been completed or, if the substrate 14 to be printed is the first substrate of the print operation, is more than the predefined time period away from the nip 53 when a pick is attempted, see step 211 in FIG. 5. In the illustrated embodiment, the predefined time period is calculated for a second or subsequent substrate of a print operation when a trailing edge of a just previously picked substrate leaves the fuser assembly nip 53. The predefined time period is calculated for a first substrate of a print operation when the controller 12 generates a command to pick a substrate from the tray 16 for a second or subsequent time if a substrate was not picked during a first attempt to pick from the tray 16 or the controller 12 attempts to pick from another tray if a substrate was not picked from an initial tray during a first pick attempt. The predefined time period is based on the current backup roller temperature, as sensed by the temperature sensor 130, using a table set out in FIG. 10 and stored in a lookup table by the controller 12. If the substrate 14 is delayed, the heater target temperature is lowered by a predefined amount, e.g., 30 degrees C., see step 212, until the substrate 14 is spaced the predefined time period away from the fuser assembly nip 53, see step 214. In the illustrated embodiment, the amount by which the heater target temperature is lowered is also selected based on the current backup roller temperature, as sensed by the temperature sensor 130, using the table set out in FIG. 10. For example, for a first substrate of a print operation determined to be late, if the sensed backup roller temperature is less than or equal to 100 degrees C. at the time when the controller 12 generates a pick instruction, the heater target temperature is modified or lowered by 30 degrees, as determined from FIG. 10, until the substrate 14 is three seconds away from the fuser assembly nip 53, also determined from FIG. 10. Once the leading edge LE of the substrate 53 is three seconds away from the fuser assembly nip 53, the normal heater target temperature is used, i.e., the reduced heater target temperature is raised by 30 degrees C. to the normal or original heater target temperature corresponding to the substrate(s) of the current print operation, see step 216 in FIG. 5. As a further example, for a second or subsequent substrate of a print operation determined to be late, if the sensed backup roller temperature is equal to 110 degrees C. at the time when a previous substrate has left the fuser assembly 30, the heater target temperature is modified or lowered by 30 degrees, as determined from FIG. 10, until the substrate 14 is two seconds away from the fuser assembly nip 53, also determined from FIG. 10. Once the leading edge LE of the substrate 53 is two seconds away from the fuser assembly nip 53, the normal heater target temperature is used, i.e., the reduced heater target temperature is raised by 30 degrees C. to the normal or original heater target temperature corresponding to the substrate(s) of the current print operation, see step 216 in FIG. 5.

If the controller 12 determines that the substrate 14 is not late, see step 211 in FIG. 5, or has implemented step 216 in FIG. 5, the controller 12 then determines if the warm-up count is less than 2 for the current print operation, see step 218 in FIG. 2. If the warm-up count is less than 2 for the print operation, the controller 12 proceeds to step 300 in FIG. 6. If the warm-up count is equal to 2, the controller 12 determines if the substrate 14, next to be printed, is less than a full width based either upon size information input by an operator or a detected substrate width if found by the controller 12 to be different from the operator input size information, see step 222 in FIG. 6. If the substrate 14 is not a full width substrate $S_{FW}$, the controller 12 proceeds to step 500 in FIG. 8. If the controller 12 determines that the substrate 14 is a full width substrate $S_{FW}$, it then determines if the backup roller temperature, as sensed by the temperature sensor 130, is greater than a lower control threshold temperature, e.g., 55 degrees C., see step 226 in FIG. 5. If the controller 12 determines that the backup roller temperature is greater than the lower control threshold temperature, the controller proceeds to step 400 in FIG. 7.

If the controller 12 determines in step 226 that the backup roller temperature is less than or equal to the lower control threshold temperature, the controller 12, using the current substrate type, e.g., transparency or paper, and current substrate path process speed, e.g., low speed or high speed, reduces a substrate pick rate from a nominal or normal pick rate to a modified pick rate for the upcoming print/fusing cycle using information from a table such as the one set out in FIG. 11 and stored in a lookup table by the controller 12, see step 230 in FIG. 5. The backup roller temperature may be less than or equal to the lower control threshold temperature when substrates 14 being printed are formed from transparency or heavy paper material. The transparency material and the heavy paper material receive a substantial amount of the heat energy generated by the heater 59 and transferred through the belt 52 to those substrates such that little heat energy passes through the substrates to the backup roller 52. Hence, by decreasing the substrate pick rate, the temperature of the backup roller 52 is allowed to increase. As an example, if a substrate 14 to be printed comprises a paper sheet moving at a low process speed, and the backup roller temperature is found to be less than the lower control threshold temperature, the substrate pick rate is reduced for the current print/fusing cycle from 15 pages per minute to 12 pages per minute such that the gap between successive substrates increases from 1.6 inches to 4.75 inches, see FIG. 11. The controller 12 maintains the heater target temperature, for the current print/fusing cycle, at a previous heater target temperature and the running count is changed to 0. After a substrate has been picked at the modified pick rate, printed and fused, the controller 12 then proceeds to step 210 in FIG. 5.

Figure 6:
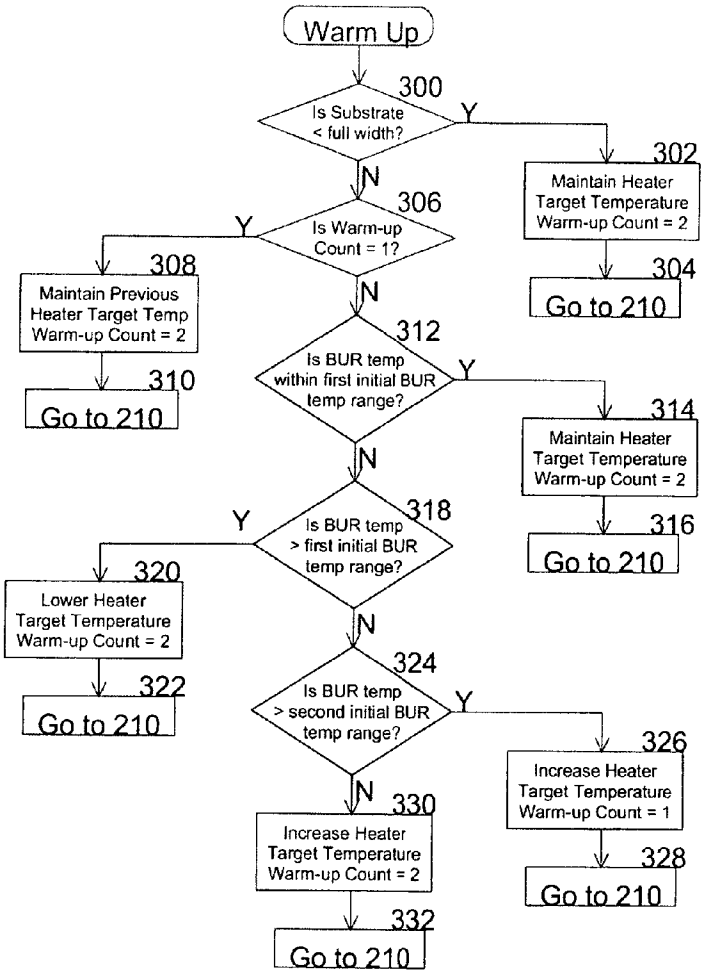

As noted above, if the controller 12 determines in step 218 that the warm-up count for the current print operation is less than 2, the controller 12 proceeds to step 300 in FIG. 6. At step 300, the controller 12 determines if the substrate 14, next to be printed, is less than a full width based either upon size information input by an operator or a detected substrate width if found by the controller 12 to be different from the operator input size information. If the substrate 14 is not a full width substrate $S_{FW}$, the controller 12 maintains the heater target temperature, for the current print/fusing cycle, at the set target temperature corresponding to the current print operation and the warm-up count is set to 2 for the print operation, see step 302. The controller 12 then proceeds to step 210 in FIG. 5. If the controller 12 determines that the substrate 14 is a full width substrate $S_{FW}$, it then determines if the warm-up count for the print operation is equal to 1, see step 306. Setting the warm-up count equal to one means that a warm-up stage is not yet completed. If yes, the controller 12 maintains the heater target temperature, for the current print/fusing cycle, at a previous heater target temperature and the warm-up count is changed to 2, see step 308, wherein the previous heater target temperature may be greater than, less than or equal to the heater target temperature determined in step 202. The controller 12 then proceeds to step 210 in FIG. 5.

If the warm-up count is not equal to 1 in step 306, the controller 12 determines if the backup roller temperature is within a first initial backup roller temperature range 600 using, for example, the data set out in a table of FIG. 9, which data may be stored in a lookup table by the controller 12, see step 312. If yes, the controller 12 maintains the heater target temperature at the original set temperature for the printing of the current substrate, sets the warm-up count for the print operation to 2 and proceeds to step 210. If the controller 12 determines that the backup roller temperature falls outside of the first initial backup roller temperature range 600, it proceeds to step 318.

The table set out in FIG. 9 further includes second, third, fourth, fifth, sixth and seventh predefined initial backup roller temperature ranges 602, 604, 606, 608, 610, 612, respectively. As is apparent from FIG. 9, the second, fourth and sixth initial backup roller temperature ranges 602, 606 and 610 are less that the first initial backup roller temperature range 600 and the third, fifth and seventh initial backup roller temperature ranges 604, 608 and 612 are greater than the first initial backup roller temperature range 600.

In step 318, the controller 12 determines if the backup roller temperature is greater than the first initial backup roller temperature range 600 prior to the picking of a next substrate 14 to be printed. If yes, the controller 12 lowers the original heater target temperature for the current print/fusing cycle by an amount corresponding to the current backup roller temperature using the data set out in the table of FIG. 9 and sets the warm-up count for the print operation to 2. For example, if the backup roller temperature is 112 degrees C., which backup roller temperature falls within the fifth initial backup roller temperature range 608 in the table of FIG. 9, the original heater target temperature is reduced by 10 degrees C. and held at that reduced value for the current print/fusing cycle. After the current print/fusing cycle has been completed with the heater target temperature reduced by 10 degrees C., the controller 12 proceeds to step 210.

If, in step 318, the controller 12 determines that the backup roller temperature is less than the first initial backup roller temperature range 600, the controller 12 increases the original heater target temperature by an amount corresponding to the current backup roller temperature using the data set out in the table of FIG. 9. For example, if the backup roller temperature is 65 degrees C., which backup roller temperature falls within the second initial backup roller temperature range 602 in the table of FIG. 9, the original heater target temperature is increased by 5 degrees C., held at that increased value for the current print/fusing cycle and the warm-up count for the print operation is set to 2, see also steps 324, 330 and 332. After the single substrate has been fused with the heater target temperature increased by 5 degrees C., the controller 12 proceeds to step 210. If the backup roller temperature is 50 degrees C., which backup roller temperature falls within the fourth initial backup roller temperature range 606 in the table of FIG. 9, the original heater target temperature is increased by 5 degrees C., held at that increased value for the current/fusing cycle and the warm-up count for the print operation is set to 1, see steps 324 and 326. The controller 12 then proceeds to step 210.

As noted above, if the controller 12 determines in step 218 that the warm-up count is equal to 2, the controller 12 then determines if the substrate 14, next to be printed, is less than a full width based either upon size information input by an operator or a detected substrate width if found by the controller 12 to be different from the operator input size information, see step 222 in FIG. 6. As also noted above, if the controller 12 determines that the substrate 14 is a full width substrate $S_{FW}$, it then determines if the backup roller temperature, as sensed by the temperature sensor 130, is greater than a lower control threshold temperature, e.g., 55 degrees C., see step 226 in FIG. 5. As further noted above, if the controller 12 determines that the backup roller temperature is greater than the lower control threshold temperature, the controller proceeds to step 400 in FIG. 7.

Figure 7:
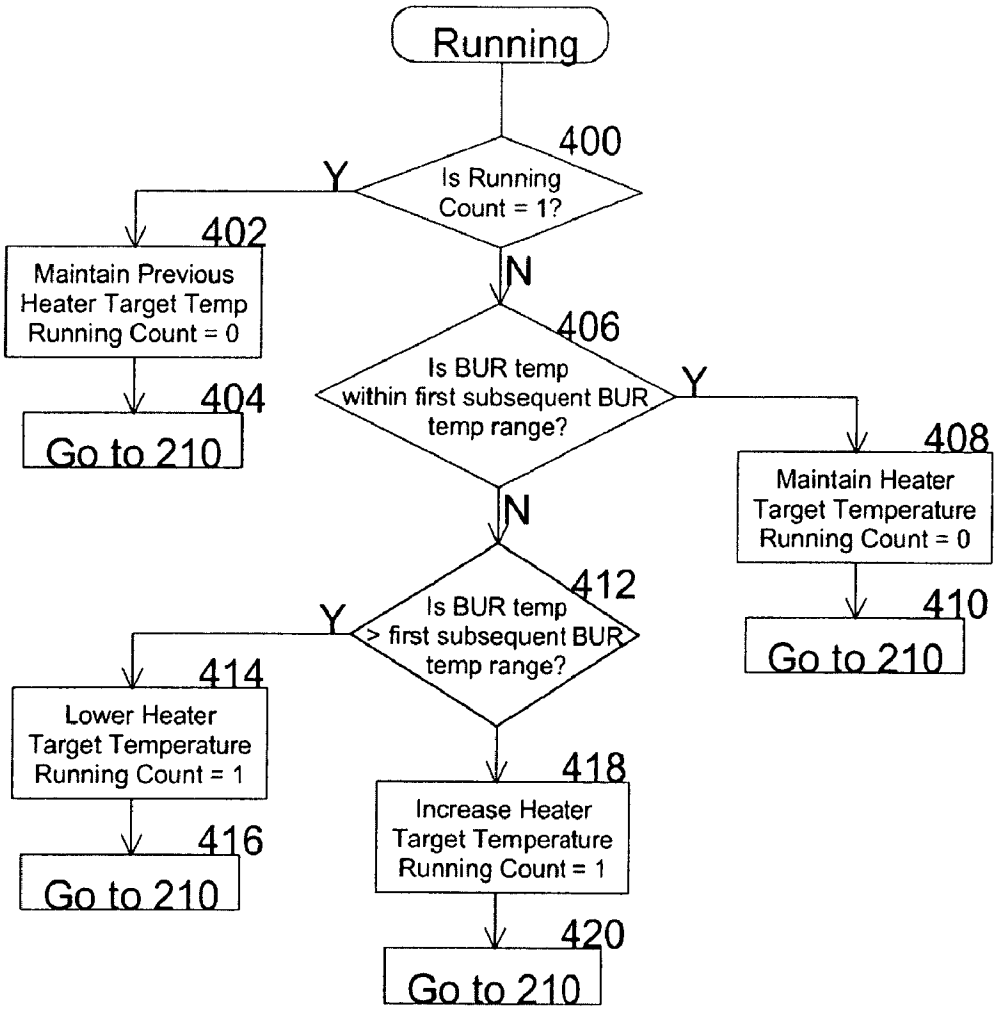

At step 400 in FIG. 7, the controller 12 determines if a running count for the print operation is equal to 1. If yes, the controller 12 maintains the heater target temperature, for the current print/fusing cycle, at a previous heater target temperature and the running count is changed to 0, wherein the previous heater target temperature may be greater than, less than or equal to the heater target temperature determined in step 202. A running count of 0 indicates that the heater target temperature, either the initial heater target temperature defined in step 202 or a previously modified heater target temperature, may be modified (again if previously modified) during a subsequent print/fusing cycle. The controller 12 then proceeds to step 210 in FIG. 5.

If the running count is not equal to 1 in step 400, the controller 12 determines if the backup roller temperature is within a first subsequent backup roller temperature range 700 using, for example, the data set out in a table of FIG. 12, which data may be stored in a lookup table by the controller 12, see step 406 in FIG. 7. If yes, the controller 12 maintains the heater target temperature, for the current print/fusing cycle, at the original set heater target temperature defined for the current print operation, sets the running count for the print operation to 0 and then proceeds to step 210. If the controller 12 determines that the backup roller temperature falls outside of the first subsequent backup roller temperature range 700, it proceeds to step 412.

The table set out in FIG. 12 further includes second, third, fourth, fifth and sixth predefined subsequent backup roller temperature ranges 702, 704, 706, 708, 710, respectively. As is apparent from FIG. 12, the second and fourth subsequent backup roller temperature ranges 702, 706 are less that the first subsequent backup roller temperature range 700 and the third, fifth and sixth subsequent backup roller temperature ranges 704, 708 and 710 are greater than the first subsequent temperature range 700.

In step 412, the controller 12 determines if the backup roller temperature is greater than the first subsequent backup roller temperature range 700. If yes, the controller 12 lowers the original heater target temperature by an amount corresponding to the current backup roller temperature using the data set out in the table of FIG. 12 and sets the running count for the print operation to 1. For example, if the backup roller temperature is equal to 112 degrees C., which backup roller temperature falls within the fifth subsequent backup roller temperature range 708 in the table of FIG. 12, the original heater target temperature is reduced by 10 degrees C., held at that reduced value for the current print/fusing cycle and the running count for the print operation is set to 1, see step 414. After the current print/fusing cycle, the controller 12 proceeds to step 210.

If, in step 412, the controller 12 determines that the backup roller temperature is less than the first subsequent backup roller temperature range 700, the controller 12 increases the original heater target temperature by an amount corresponding to the current backup roller temperature using the data set out in the table of FIG. 12. For example, if the backup roller temperature is 75 degrees C., which backup roller temperature falls within the second initial backup roller temperature range 702 in the table of FIG. 12, the original heater target temperature is increased by 5 degrees C., held at that increased value for the current print/fusing cycle and the running count for the print operation is set to 1, see also step 418. After the current print/fusing cycle, the controller 12 proceeds to step 210.

As noted above, if the warm-up count in step 218 is equal to 2, the controller 12 then determines if the substrate 14, next to be printed, is less than a full width based either upon size information input by an operator or a detected substrate width if found by the controller 12 to be different from the operator input size information, see step 222 in FIG. 5. If the substrate 14 is not a full width substrate $S_{FW}$, the controller 12 proceeds to step 500 in FIG. 8.

In step 500, the controller 12 sets the running count for the print operation to 0 and proceeds to step 501. In step 501, the controller 12 determines, from operator input information, whether the substrate 14, to be printed next, is an envelope. If so, the controller 12 selects a substrate pick rate and, if appropriate, an adjustment to the heater target temperature corresponding to the current print operation using the current backup roller temperature and the data set out in a table of FIG. 13 for an envelope, which data may be stored by the controller 12 in a lookup table.

In FIG. 13, first, second, third, fourth and fifth envelope backup roller index temperature ranges 801-805, respectively, are provided in the table. Further, first, second, third, fourth and fifth interpage gap distances 806-810, respectively, are set out in the table of FIG. 13, wherein the first, second, third, fourth and fifth interpage gap distances 806-810 correspond to first, second, third, fourth and fifth substrate pick rates. The data set out in the table of FIG. 13 may be stored by the controller 12 in a lookup table.

For example, in step 502, if the controller 12 determines that the backup roller temperature is equal to 175 degrees C., which temperature falls within the third envelope backup roller index temperature range 803, the controller 12 picks the envelopes at the third pick rate corresponding to the third interpage gap 808, wherein the third interpage gap 808 equals 10 inches in FIG. 13. The controller 12 further modifies the heater target temperature by lowering it 15 degrees C., which amount is found in the column defined "Heater Offset degrees C." After the current print/fusing cycle, the controller 12 proceeds to step 210.

Figure 8:
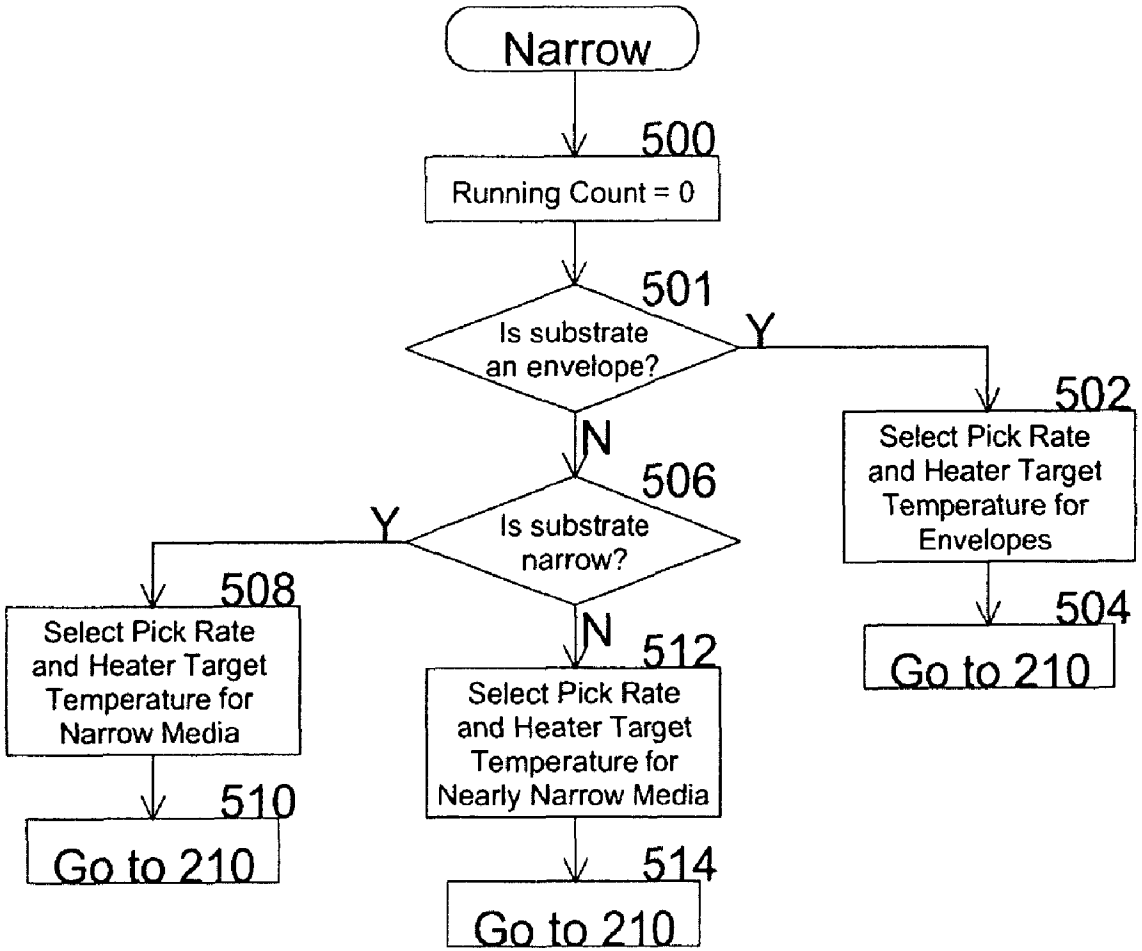

If, in step 501, the controller 12 determines that the substrate 14, next to be printed, is not an envelope, it then determines if the substrate is a narrow width substrate $S_{NW}$ based either upon size information input by an operator or a detected substrate width if found by the controller 12 to be different from the operator input size information, see step 506 in FIG. 8. If the substrate 14 is a narrow width substrate $S_{NW}$, the controller 12 selects a substrate pick rate and, if appropriate, an adjustment to the heater target temperature corresponding to the current print operation using the current backup roller temperature and the data set out in the table of FIG. 13 for a narrow width substrate $S_{NW}$.

In FIG. 13, first, second and third narrow width backup roller index temperature ranges 811-813, respectively, are set out. Further, first, second and third interpage gap distances 816-818, respectively, are set out in FIG. 13, wherein the first, second and third interpage gap distances 816-818 correspond to first, second and third substrate pick rates for narrow width substrates $S_{NW}$.

For example, in step 508, if the controller 12 determines that the backup roller temperature is equal to 185 degrees C., which temperature falls within the second narrow width backup roller index temperature range 812, the controller 12 picks the narrow width substrate 14 at the second pick rate corresponding to the second interpage gap 817, wherein the second interpage gap 817 equals 11.2 inches in FIG. 13. The controller 12 further modifies the heater target temperature by lowering it 15 degrees C., which amount is found in the column defined "Heater Offset degrees C." After the current print/fusing cycle, the controller 12 proceeds to step 210.

If, in step 506, the controller 12 determines that the substrate 14, next to be printed, is not a narrow width substrate $S_{NW}$, the controller 12 concludes that the substrate 14 is a mid-width substrate $S_{MW}$ (also referred to as a nearly narrow substrate). The controller 12 then selects a substrate pick rate and, if appropriate, an adjustment to the heater target temperature corresponding to the current print operation using the current backup roller temperature and the data set out in the table of FIG. 13 for a mid-width substrate $S_{MW}$.

In FIG. 13, first, second and third mid-width backup roller index temperature ranges 821-823, respectively, are set out. Further, first, second and third interpage gap distances 826-828, respectively, are set out in FIG. 13, wherein the first, second and third interpage gap distances 826-828 correspond to first, second and third substrate pick rates for mid-width substrates $S_{MW}$.

For example, in step 512, if the controller 12 determines that the backup roller temperature is equal to 185 degrees C., which temperature falls within the second mid-width backup roller index temperature range 822, the controller 12 picks the mid-width width substrate $S_{MW}$ at the second pick rate corresponding to the second interpage gap 827, wherein the second interpage gap 827 equals 9 inches in FIG. 13. The controller 12 further modifies the heater target temperature by lowering it 10 degrees C., which amount is found in the column defined "Heater Offset degrees C." After the current print/fusing cycle, the controller 12 proceeds to step 210.

It is noted that when the controller 12 receives a second print operation comprising a substrate or substrates wider than the substrate(s) of the previous print operation, e.g., a second print operation comprising mid-width substrates $S_{MW}$ wherein the first print operation comprised narrow width substrates $S_{NW}$, the controller 12 waits until the backup roller temperature has cooled down to a reset temperature, e.g., 120 degrees C., prior to picking the first substrate of the second print operation. The controller 12 then returns to step 202.

The controller 12 deactivates the heater 59 when a previously fused substrate comprised a normal type substrate, i.e., a non-envelope substrate, and a substrate next to pass through the fuser assembly 30 of a subsequent print operation is an envelope or when a previously fused substrate comprised an envelope and a substrate next to pass through the fuser assembly 30 of a subsequent print operation is a normal type substrate until a temperature of the backup roller is less than a reset temperature, e.g., 120 degrees C. The controller 12 waits until the backup roller temperature has cooled down to the reset temperature prior to picking the first substrate of the subsequent print operation. The controller 12 then returns to step 202.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A printer comprising:

substrate transport apparatus for moving substrates along a substrate path through the printer;

a media sensor positioned along said substrate path so as to be actuated by mid-width substrates and full width substrates but not by narrow width substrates;

a fuser assembly comprising a heat transfer member including a belt and a heater to heat said belt, a backup member adapted to engage said belt so as to define a fusing nip with said belt, and a temperature sensor for sensing a temperature of a portion of said backup member engaging full width substrates and not engaging mid-width substrates and not engaging narrow width substrates; and a controller coupled to said media sensor and said temperature sensor and based on signals generated by said media sensor and said temperature sensor determining whether a substrate moving along said substrate path and through said fuser assembly comprises a narrow width substrate, a mid-width substrate or a full width substrate.

2. The printer as set out in claim 1, wherein said heat transfer member comprises:

a heater assembly comprising said heater and a housing for mounting said heater; and said belt comprising a flexible belt positioned about said heater assembly and including an inner surface engageable with said heater so as to receive energy in the form of heat generated by said heater.

3. The printer as set out in claim 2, wherein said backup member comprises a driven backup member positioned in opposition to said heater assembly, said flexible belt extending between said heater assembly and said driven backup member such that said fusing nip is defined between said backup member and said flexible belt.

4. The printer as set out in claim 1, further comprising a reference edge for contact by an edge of a substrate moving along said substrate path.

5. The printer as set out in claim 4, wherein said media sensor is positioned a spaced distance away from said reference edge so as to be actuated by mid-width substrates and full width substrates but not by narrow width substrates.

6. The printer as set out in claim 5, wherein said temperature sensor is positioned a spaced distance away from said reference edge so as to sense the temperature of said backup member portion engaging full width substrates and not engaging mid-width substrates and not engaging narrow width substrates.

7. The printer as set out in claim 6, wherein the full width substrates are capable of being moved along the paper path by said substrate transport apparatus at full rated process speed without said backup member overheating.

8. The printer as set out in claim 1, wherein said controller samples said temperature sensor during each fusing cycle at a first point in time after a leading edge of a substrate passes through said fusing nip and a first section on the backup member contacted by a portion of the substrate spaced from the leading edge moves adjacent to where said temperature sensor is located.

9. The printer as set out in claim 8, wherein said controller samples said temperature sensor during each fusing cycle at a second point in time after a trailing edge of the substrate passes through said fusing nip and a second section on the backup member contacted by a portion of the substrate spaced from the trailing edge moves adjacent to where said temperature sensor is located.

10. The printer as set out in claim 9, wherein said controller takes the difference between samples of said temperature sensor at said first and second points in time and determines that a substrate is a full width substrate if the temperature taken at the second point in time is less than the temperature taken at the first point in time and determines that the substrate is either a mid-width substrate or a narrow width substrate if the temperature taken at the second point in time is greater than the temperature taken at the first point in time.

11. The printer as set out in claim 10, wherein said controller samples said media sensor during a print cycle and determines that a substrate is a mid-width substrate or a full width substrate if said media sensor is actuated as the substrate passes said media sensor and determines that the substrate is a narrow width substrate if said media sensor is not actuated as said substrate passes said media sensor.

12. The printer as set out in claim 11, wherein said controller determines that a substrate is a narrow width substrate if said media sensor is not actuated by the substrate; determines that a substrate is a mid-width substrate if the temperature sensed by the temperature sensor taken at the second point in time is greater than the temperature sensed by the temperature sensor taken at the first point in time and said media sensor is actuated by the substrate; and determines that a substrate is a full width substrate if the temperature sensed by the temperature sensor taken at the second point in time is less than the temperature sensed by the temperature sensor taken at the first point in time and said media sensor is actuated by the substrate.

13. A printer comprising:

a media sensor positioned along a substrate path in the printer and actuated only by substrates in the substrate path having a first subset of widths;

a fuser assembly for fusing toner to substrates moved through the fuser assembly, including a backup member and a temperature sensor for sensing a temperature of a portion of the backup member engaging substrates moving through the fuser assembly having only a second subset of widths, the first and second sets being different with respect to at least one substrate width; and a controller coupled to the media sensor and the temperature sensor for determining whether a substrate moving through the fuser assembly is a narrow width substrate, a mid-width substrate or a full width substrate.

14. The printer as set out in claim 13, further comprising a reference edge for contact by an edge of a substrate moving along the substrate path, wherein the media sensor is positioned a spaced distance away from the reference edge so as to be actuated only by substrates having the first set of widths.

15. The printer as set out in claim 14, wherein the temperature sensor is positioned a spaced distance away from the reference edge so as to sense the temperature of the backup member portion engaging only substrates having the second set of widths.

16. The printer as set out in claim 13, wherein the controller samples the temperature sensor during each fusing cycle at a first point in time after a leading edge of a substrate passes through the fusing nip and a first section on the backup member contacted by a portion of the substrate spaced from the leading edge moves adjacent to where the temperature sensor is located.

17. The printer as set out in claim 16, wherein the controller samples the temperature sensor during each fusing cycle at a second point in time after a trailing edge of the substrate passes through the fusing nip and a second section on the backup member contacted by a portion of the substrate spaced from the trailing edge moves adjacent to where the temperature sensor is located.

18. The printer as set out in claim 17, wherein the controller takes the difference between samples of the temperature sensor at the first and second points in time and determines that a substrate is a full width substrate if the temperature taken at the second point in time is less than the temperature taken at the first point in time and determines that the substrate is either a mid-width substrate or a narrow width substrate if the temperature taken at the second point in time is greater than the temperature taken at the first point in time.

19. The printer as set out in claim 13, wherein the controller samples the media sensor during a print cycle and determines that a substrate is a mid-width substrate or a full width substrate if the media sensor is actuated as the substrate passes the media sensor and determines that the substrate is a narrow width substrate if the media sensor is not actuated as the substrate passes the media sensor.

20. The printer as set out in claim 17, wherein the controller determines that a substrate is a narrow width substrate if the media sensor is not actuated by the substrate; determines that a substrate is a mid-width substrate if the temperature sensed by the temperature sensor taken at the second point in time is greater than the temperature sensed by the temperature sensor taken at the first point in time and the media sensor is actuated by the substrate; and determines that a substrate is a full width substrate if the temperature sensed by the temperature sensor taken at the second point in time is less than the temperature sensed by the temperature sensor taken at the first point in time and the media sensor is actuated by the substrate.

* * * * *